United States Patent [19]

Wallace

[11] 4,399,166

[45] Aug. 16, 1983

[54] FRICTION LOCK FOR THREADS

[75] Inventor: Richard B. Wallace, Bloomfield Hills, Mich.

[73] Assignee: The Oakland Corporation, Troy, Mich.

[21] Appl. No.: 271,531

[22] Filed: Jun. 8, 1981

[51] Int. Cl.[3] ..... B05D 3/02; B05D 1/12

[52] U.S. Cl. ..... 427/195; 427/197; 427/202; 427/374.1; 427/368; 427/374.2; 427/374.4; 118/308; 118/310; 10/10 P; 411/258

[58] Field of Search ..... 118/308, 310; 427/195, 427/197, 202, 374.1, 374.2, 374.4; 10/10 P; 411/258

[56] References Cited

U.S. PATENT DOCUMENTS

| | | | |
|---|---|---|---|
| 2,974,059 | 3/1961 | Gemmer | 427/195 X |
| 3,293,977 | 12/1966 | Dalton et al. | 427/202 |
| 3,579,684 | 5/1971 | Duffy | 427/195 |
| 3,795,224 | 3/1974 | Batson | 118/308 |
| 3,911,160 | 10/1975 | Neuberg | 427/197 X |
| 4,147,819 | 4/1979 | Hukumoto et al. | 427/379 X |
| 4,285,378 | 8/1981 | Wallace | 427/195 |

FOREIGN PATENT DOCUMENTS

| | | | |
|---|---|---|---|
| 47-24649 | 7/1972 | Japan | 427/202 |
| 488544 | 5/1970 | Switzerland | 427/202 |

*Primary Examiner*—Shrive P. Beck

*Attorney, Agent, or Firm*—Barnes, Kisselle, Raisch, Choate, Whittemore & Hulbert

[57] ABSTRACT

Method and apparatus for providing friction producing ring patches on externally threaded fasteners which comprises depositing a fluid wetting agent on a predetermined thread area, supplying thermoplastic resin powder particles to the fluid deposit to form deposits of fluid mixtures, flash heating the mixture deposit to fuse resin particles only at the surfaces to produce a non-tacky skin, accumulating agglomerations of the fasteners and retaining them for an interval sufficient to permit at least substantially complete drying of the fluid mixture deposits to form substantially solid cohesive deposits of discrete resin particles, mass heating the fasteners to fuse the discrete resin particles into continuous fluid deposits and finally cooling the fasteners in separated condition to set the fused resin deposits into solid continuous resin deposits fused to the thread surfaces of the fasteners.

27 Claims, 9 Drawing Figures

FRICTION LOCK FOR THREADS

STATE OF THE ART

The procedure for treating metal fasteners with friction means for the primary purpose of preventing loosening of fasteners has progressed through a series of consecutive developments. Initially, friction material such as latex, polyvinyl, proteins, or pitch was simply applied to the threads with or without the inclusion of abrasive producing material.

A radical departure from this rather crude beginning involved the provision of cured resin friction elements such as buttons of a material such as nylon within recesses formed in the threaded portion of a fastener. Obviously the formation of recesses for receiving the friction elements was relatively expensive and a major advance involved the production of the articles by heating the fasteners to a temperature sufficient to fuse nylon powder and applying the nylon powder to the heated fasteners which cause the nylon particles to fuse into a solid material adequately bonded by fusion to the threaded surfaces.

An improvement which eliminated the difficulties inherent in applying powdered resin to extremely hot fasteners was the use of a slurry formed of a liquid carrier and resin particles which was applied to the thread surface, after which the liquid carrier was evaporated to leave a substantially solid cohesive deposit formed of discrete resin particles which were thereafter fused into a solid friction deposit. This improvement was disclosed in applicant's co-pending application, Ser. No. 892,505, filed Apr. 3, 1978, now abandoned. The present application is an improvement over the subject matter of the earlier application.

BRIEF DESCRIPTION

The present invention has as a principal objective the mass production of friction thread fasteners in an operation which requires a minimum of handling and which conserves energy by combining sequential application of friction material to a series of fasteners with subsequent heat treatment in a batch type furnace or its practical equivalent.

Described in general terms, a series of threaded fasteners such as headed bolts are advanced with their axis vertical between a pair of belts which engage under the heads of the fasteners. The fasteners may be separated from each other on the conveyor belts or, as is preferred, they may be advanced in a solid array with the heads of adjacent fasteners in contact.

As the series of fasteners advance a fluid wetting agent is applied to an area of the threads on which the friction material is to appear. In accordance with the present invention this area is preferably annular and extends around the threaded portion of a fastener at a point removed from the entry end of the threads to facilitate threading with a mating nut or the like. Conveniently the application of the fluid wetting agent is by passing the advancing array of bolts between opposed fluid applicators, which may be in the form of porous or sponge rollers continuously supplied with the wetting agent and adapted to apply a substantially uniform annular deposit completely around the threaded fasteners.

Thereafter while the annular deposit of fluid wetting agent remains in fluid condition, a powder consisting of particles of a thermoplastic resin is applied to the fluid deposit to produce a deposit of the mixture of the fluid wetting agent and powder having substantially the same shape and size as the initial deposit of the wetting agent. Conveniently this is accomplished by directing a quantity of powder onto the deposit of the wetting agent and it is unnecessary to limit the area to which the powder is applied, since it will adhere to the threaded fasteners only where it encounters and mixes with the deposit of the wetting agent.

This may conveniently take place within a substantially closed chamber so that any resin particles which are not taken into the fluid wetting agent may be collected for reuse. This chamber may if desired be provided with air jets adapted to remove any random deposit of powder onto the threaded fasteners at areas other than the fluid deposit.

Thereafter the series of fasteners with the deposit of fluid mixture of the wetting agent and powder are continued to advance and are subjected to a flash heating operation in which heat is supplied directly to the surface of the mixture deposits for a brief interval sufficiently to fuse resin particles only at the surface of the deposit and to eliminate the wetting agent. It does not provide a fused bond between the thread surface and the resin. Upon cooling immediately after flash heating, these fused particles solidify into a skin which renders the deposits non-tacky and which permits agglomeration of the fasteners without difficulties caused by fasteners sticking together.

When the fluid wetting agent has been substantially eliminated, the mixture deposits are converted into substantially solid, cohesive deposits of discrete or partly fused resin particles. Since these particles are at this time essentially discrete, the deposits exhibit no significant strength nor are they adhered strongly to the thread surfaces. However since they are substantially completely contained within thread grooves of the fasteners, they are protected and may be handled without damage to the deposits.

The final heat treatment is accomplished in batch furnaces or the equivalent in a manner which represents a great savings in energy over that which would be required if the individual fasteners were advanced in series through the final heating oven.

Conveniently the fasteners with the dried deposits thereon are randomly placed on a slowly advancing belt of whatever width is convenient and the belt is fed relatively slowly through a short oven or heating chamber. The heating chamber is maintained at a temperature so related to the rate of advance that the discrete resin particles are fused during passage through the furnace into a continuous fluid resin deposit, which however retains substantially the original shape and size of the deposit of the fluid wetting agent.

The foregoing fusing operation is generally equivalent to simple batch type heating in which baskets or other containers of the fasteners are placed for a predetermined time in an oven and then removed. However it is preferred to advance the fasteners through the oven because this permits the final quenching or cooling of the fluid resin deposits in a way which insures that the fasteners are essentially completely separated from each other as the fused resin solidifies.

This is accomplished by providing a container at the end of the endless conveyor containing a bath of coolant which may for example be water or oil and water which causes the fused resin to set substantially instantaneously in order to assure substantially complete separation between the individual fasteners as they drop into the cooling bath. A rotating brush may be provided at the end of the conveyor which will brush the fasteners into the bath and will cause separation between any fasteners temporarily adhered together as a result of the presence of the fused resin.

The fasteners after removal from the bath and drainage of the coolant therefrom are in finished condition.

It will be noted that the only handling of individual fasteners throughout the entire operation is the application of the fasteners as accumulated from the initial conveyor onto the belt which advanced them into the oven.

DETAILED DESCRIPTION

Figure 1:
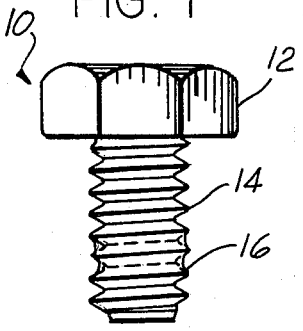
FIG. 1 is an elevational view of a friction fastener resulting from the present invention.

Referring now to FIG. 1 there is shown a threaded fastener in the form of a bolt 10 having a head 12 and a threaded shank 14 provided with conventional threads. Intermediate the ends of the threaded shank is a friction zone 16 which is formed by a deposit of a friction resin, preferably nylon, which is received in the thread grooves. The resin is in a continuous solid condition and is strongly bonded by fusion to the adjacent surfaces of the threaded surfaces. The fact that the friction zone is separated from the entry end of the bolt facilitates initial engagement of the bolt with a mating member.

While the present disclosure is primarily intended for the production of an annular band of friction material, the present invention may also be practiced in an obvious manner by providing a friction material in one or more separated patches which do not extend around the circumference of a threaded member and which are sometimes referred to as patch-patch.

Figure 5:
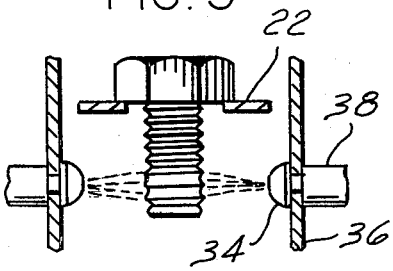
FIG. 5 is an enlarged fragmentary view illustrating an application of the powder to the fasteners.
Figure 6:
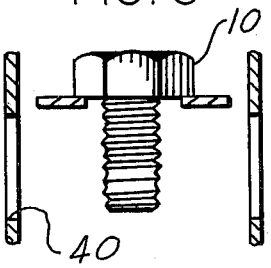
FIG. 6 is a view similar to FIG. 6 illustrating the apparatus for removing excess powder from surfaces of the fasteners.

In accordance with the present invention an initial conveyor 20 is provided which may take the form of a pair of endless belts 22 as best seen in FIG. 5 so that the bolts 10 are supported and advanced thereon with the axes of the bolts vertical, the bolts being supported by the heads 12 engaging spaced apart edge portions of the belts 22.

Figure 2:
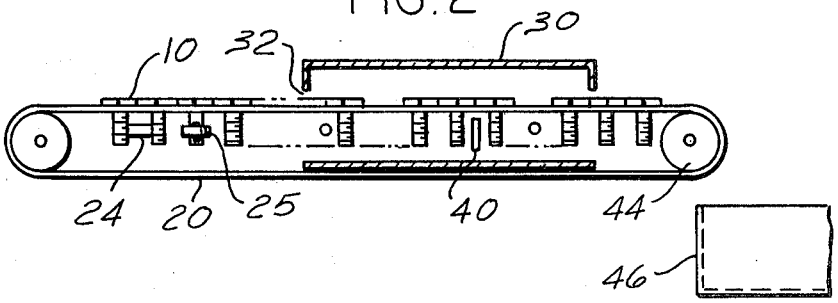
FIG. 2 is a diagrammatical side elevational view of the apparatus for applying the material to the fasteners.

It will be understood that the fasteners 10 may form a continuous array with the heads of the adjacent bolts and contact as shown in FIG. 2 or the heads of the bolts may be separated as desired.

If desired, suitable feed means of known type may be provided to supply the bolts to the conveyor.

As the bolts advance the intermediate threaded portion thereof is contacted by one or more fluid applicators 24. Conveniently these applicators may be provided in one or more opposed pairs at opposite sides of the array of bolts but in FIG. 2 for clarity one such applicator is shown at 24 and a second applicator 25 is illustrated as at the opposite side of the bolts.

It will be noted that no heating means is provided prior to application of the fluid wetting agent, so that the fluid is applied at ambient temperature.

Figure 3:
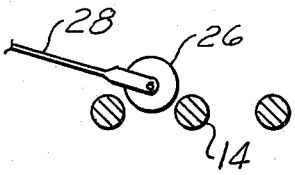
FIGS. 3 and 4 are diagrammatical views suggesting the use of spring rollers for applying fluid to the fasteners.
Figure 4:
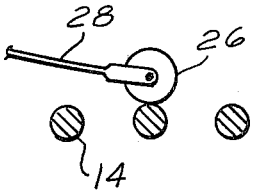

As suggested in FIGS. 3 and 4 the fluid applicators may include porous or spongy rollers 26 carried by flexible spring arms 28 which normally position a roller 26 substantially between the shanks 14 of adjacent bolts 10. As the bolts advance the roller 26 as seen in FIG. 4 is displaced and the arm 28 is biased to cause the roller to pass over the adjacent side of the bolt and enter the space between it and the next following bolt. With this arrangement the fluid wetting agent is supplied in a continuous 360° annular zone around an intermediate portion of a bolt in the position illustrated at 16 in FIG. 1. It will be understood that if a heavier deposit of a fluid wetting agent is required, two or more pairs of rollers 24, 26 may be provided.

The particular wetting agents selected is eliminated in the finished product and accordingly is selected only for its compatability with the method as described. It is found that an acrylate monomer sold as a "reactive diluent" by Rohm and Haas under their identification QM 672 is completely satisfactory. This material has a boiling point of about 350° C., and is a slightly syrupy viscous liquid which contributes to its ability to retain the shape of its initial deposit and also to take into it the powder resin material as will later be described. The desired shape is one which fills the bottom of the thread groove, and when combined with powder to form a mixture or slurry, extends nearly to but not beyond the thread crest and has an outwardly concavely curved surface all as clearly seen in FIG. 1.

Alternatively, ethylene or propylene glycols may be used as the liquid carrier or wetting agent.

Immediately after the application of the wetting agent the fasteners 10 advance to a chamber 30 which is substantially closed except for the end openings indicated at 32 for passage of the fasteners therethrough. As the fasteners advance into the chamber resin powder is supplied to the deposit of fluid wetting agent. It is not necessary to limit the application of the supply of powder directly to the deposit of wetting agent, since any of the powder which does not fall upon and be taken into the wetting agent, does not adhere to the fastener. Accordingly as best indicated in FIG. 5 the powder may be supplied through ports or jets 34 formed in the sidewalls 36 of the chamber 30 to which ports powder is supplied by conduits 38 through which air and the powder are blown. Ports 34 are directed to the intermediate wetted zone of the bolts but may in fact form a cloud through which the bolts advance.

If it is found that an undesirable amount of the resin powder remains on the uncoated threads or other portions of the fasteners, this may be removed by air jets connected to ports 40 in the sidewalls of the chamber 30. In either case excess powdered resin is collected and may be removed from the chamber, either continuously as desired or periodically.

The resin powder may be produced from cured nylon such for example as nylon 6 or nylon 11 as is familiar in the art. These grades of nylon have been found to be particularly effective in producing the required friction-opposing rotation of the fastener with a mated member and also to have the potentiality for strong bonding by fusion to thread surfaces. Preferably the powder is relatively fine as for example of electrostatic grade, which means simply that it is sufficiently fine to be capable of being applied to surfaces by means of an electrostatic field. However coarser grades of powder are applicable and in many cases are preferable if the method is applied to the production of relatively large threaded fasteners.

It will be noted that no heating of the fastener occurs prior to application of the powder, so that the fluid wetting agent remains in its fluid condition.

After the threaded fasteners pass the powder applicators and, if employed, the air jet cleaners, the deposits in the thread grooves of the fasteners are in the form of a fluid mixture or slurry of the initial fluid wetting agent and the powder resin. The fluidity of the mixture deposit depends of course upon the amount of wetting agent initially deposited and the amount of powder supplied to and taken into the fluid wetting agent deposit. It is noted that the application of the powder as by jets 34 may cause the powder to penetrate and be taken into the wetting agent deposit so as to produce a mixture deposit which is of course less fluid than the initial deposit of the wetting agent. It however remains in a fluid state and contains so much wetting agent that it would not be desirable to attempt to simultaneously dry the deposit and fuse the resin particles. Moreover a significant advantage of the present invention is that the final fusion of the resin particles takes place in a batch type or generally equivalent furnace with corresponding savings of energy.

In any case the physical condition of the mixture deposits at this time is such that the fasteners could not be agglomerated without causing substantial displacement or damage to the deposits as a result of contact with adjacent fasteners, even though the deposits are substantially completely located within the thread grooves and below the thread crests, and thus partially protected.

Figure 7:
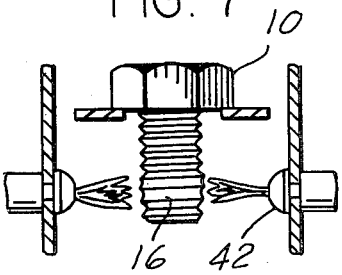
FIG. 7 is a view similar to FIG. 6 illustrating the flash fusion of the surface particles of the deposits.

In order to permit agglomeration of the fasteners for an intermediate drying phase, the chamber 30 or similar chamber directly adjacent thereto is provided with means for flash fusing resin particles located primarily at and adjacent the surfaces of the deposits of the fluid mixture or slurry. This is best indicated in FIG. 7 where the fasteners 10 pass between opposed nozzles 42 to which a suitable gaseous fuel is fed to produce flames impinging directly on the surfaces of the deposits indicated in this figure at 16. An application of flames directly to the surfaces of the deposits produces flash fusing of the surface particles and eliminates the fluid wetting agent, without substantially heating the bodies of the fasteners. Resin particles within the deposit may be partly fused, but no fused bond is established with the thread surfaces. Upon passing the jets 42, the surfaces of the deposits cool rapidly to produce a non-tacky protective cover or skin over the deposits therebeneath.

Obviously instead of employing flame jets 42, other flash fusing devices such for example as high intensity infrared or other radiation type units could be substituted.

As the protective non-tacky skin is formed substantially immediately after passing the jets, fasteners 10 may be permitted to fall off a turnaround at the roller 44 of the conveyor 20 into suitable containers indicated at 46. At that time the fasteners may assume random positions since they will not adhere together, and this condition is referred to herein as an agglomeration.

The agglomeration of fasteners may be retained in the containers 46 or other storage containers, until the intermediate drying phase has been completed or for as much longer as desired and the final fusion operation performed only when a large quantity of fasteners is available for final treatment.

The method as described results in the simultaneous formation of the slurry or mixture of wetting agent and resin powder as the powder is supplied to the wetting agent. It also provides for more advantageous deposition of the wetting agent alone from rollers or the like, followed by the addition of powder in a subsequent operation.

Figure 8:
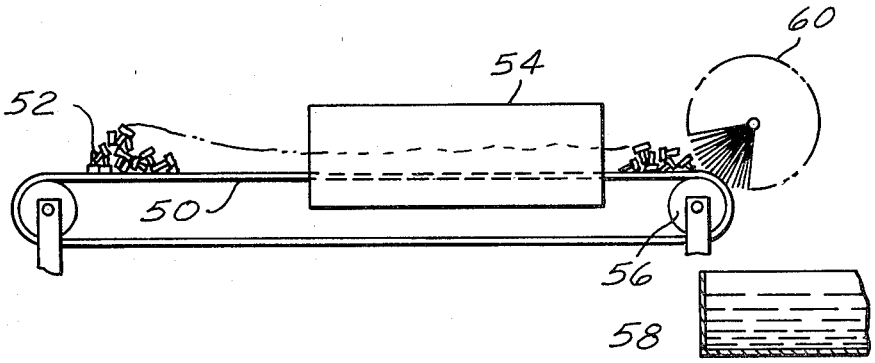
FIG. 8 is a diagrammatical elevational view showing the apparatus for advancing the fasteners in a random mass on the conveyor through the heating oven.
Figure 9:
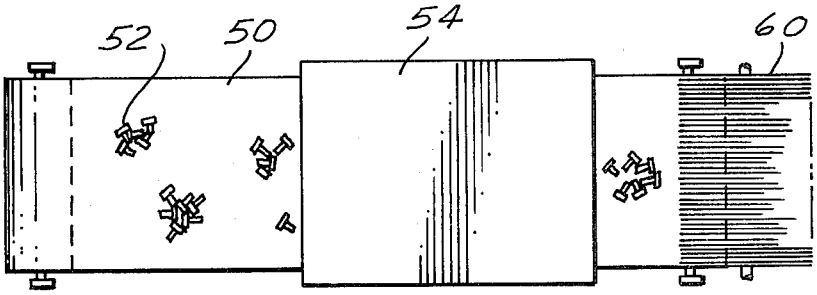
FIG. 9 is a diagrammatical plan view of the apparatus shown in FIG. 8.

Reference is now made to FIGS. 8 and 9 which illustrate the final fusion and solidification of the friction material.

As stated earlier the fasteners provided with solid deposits of discrete resin particles, may be finished in a fusion operation by placing baskets of the fasteners in a batch type oven for an interval sufficient to fuse the resin particles into a continuous fluid resin deposit. While these deposits remain fluid, the baskets may be removed from the oven and emptied into a cooling bath of water or oil and water, in such a way that the individual fasteners are separated as the fluid resin deposits solidify. This permits the most economical use of heating energy particularly when contrasted with an operation in which the fasteners might be advanced in single file through an elongated heating chamber, as a continuation of the formation of slurry deposits as shown in FIGS. 1–7.

However it is preferred to advance the fasteners in substantially random agglomeration on a belt 50, as indicated at 52 as the belt is advanced slowly through a relatively short oven or heating chamber 54. The rate of advance and the temperature of the oven are so related that as the fasteners reach a turnaround roller 56 at the end of the chamber 54, the discrete resin particles have been fused into a substantially continuous condition, preferably in which the deposits are effectively deposits of fluid resin. As such, although it is possible for treated or other portions of one fastener to be in contact with the fused resin on another of the individual fasteners, there is no appreciable adhesion or sticking together.

At this time the fasteners are permitted to fall off the end of the belt as it passes the turnaround roller 56 into cooling tank 58 which contains a cooling bath which may be water or a mixture of water and oil. The resin deposits solidify abruptly as they drop into the cooling baths and due to their separated condition there is no adhesion or sticking together of the finished fasteners.

This result may be ensured by the addition of a rotating brush 60 at the discharge end of the conveyor belt 50, which will brush the fasteners individually from the belt into the cooling bath.

All that remains is to cool the finished fasteners and to drain the coolant therefrom. Where the coolant bath includes oil as suggested above, the finished fasteners are protected by an oil film coating.

The foregoing provides for mass production of fasteners without requiring multiple handling operations. Moreover the invention is most economical of energy since the heating operation which fuses all of the resin particles is carried out in what may properly be considered a batch type operation, or its equivalent, whether the articles are contained in baskets or the like during the heating operation or simply advanced in random heaped condition on a belt through the chamber.

I claim:

1. The method of preparing a multiplicity of externally threaded fasteners for subsequent substantially mass heat treatment in an energy conserving operation in which substantially solid coherent deposits consisting essentially of discrete thermoplastic resin powder particles are fused, which comprises continuously advancing a series of fasteners with their axes vertical, sequentially forming deposits consisting essentially of a viscous fluid wetting agent of predetermined size and shape in the thread grooves of the fasteners as they advance, thereafter supplying thermoplastic resin powder to the surfaces of the deposits of fluid wetting agent to penetrate and form therewith fluid mixture slurry deposits substantially of the aforesaid size and shape which in cross-section fill the bottoms of the thread grooves, and extend nearly to but not beyond the thread crests, sequentially fusing the resin powder particles at the surfaces of the deposits and eliminating the fluid wetting agent thereat as the fasteners continue to advance without heating the deposits or fasteners sufficiently to produce a fused bond between the deposits and thread surfaces, cooling the deposits to cause the fused surface particles to form a non-tacky skin over the deposits, accumulating the fasteners in agglomerated condition and retaining them until enough have been accumulated for economical mass heat treatment to fuse the resin to the thread surface.

2. The method defined in claim 1, in which the wetting agent is an acrylate monomer.

3. The method defined in claim 2, in which the resin is nylon.

4. The method defined in claim 1 in which forming the deposit of fluid wetting agent comprises advancing the fasteners with their axes vertical and passing the articles between opposed fluid applicators to form the deposit of wetting agent in a ring around the threaded portion of each fastener.

5. The method defined in claim 4, in which the applicators are porous rollers.

6. The method defined in claim 1, in which supplying the resin powder to the deposit of wetting agent comprises applying a quantity of powder throughout an area larger than but including the areas occupied by the deposits of wetting agent whereby only powder applied to the wetting agent is retained on the fasteners.

7. The method defined in claim 6, in which application of the powder comprises blowing the powder onto the threaded areas of the fasteners which carry the deposits of wetting agent.

8. The method defined in claim 7, which comprises advancing the fasteners through a housing shield during application of the powder.

9. The method defined in claim 1, in which fusion of the powder particles at the surfaces of the deposits of the fluid mixture comprises concentrating heat only at the surfaces of the mixture deposits.

10. The method defined in claim 9, in which the concentration of heat at the surface of the mixture deposits comprises directing a flame onto the mixture deposits.

11. The method of making friction threaded fasteners which comprises continuously advancing a series of fasteners with their axes vertical, sequentially forming deposits consisting essentially of a viscous fluid wetting agent of predetermined size and shape in the thread grooves of the fasteners as they advance, thereafter sequentially supplying thermoplastic resin powder to the surfaces of the deposits of fluid wetting agent to form therewith fluid slurry mixture deposits of the aforesaid size and shape which in cross-section fill the bottoms of the thread grooves and extend nearly to but not beyond the thread crests, fusing the resin powder particles at the surfaces of the mixture deposits as the fasteners continue to advance and simultaneously substantially eliminating the fluid wetting agent from the mixture, cooling the deposits to cause the fused surface particles to form a non-tacky skin over the deposits, accumulating the fasteners in agglomerated condition and retaining them until the mixture deposits have dried to form substantially solid cohesive deposits of discrete powder particles, and fusing the solid deposits of discrete resin particles comprising substantially simultaneously heating a quantity of fasteners.

12. The method defined in claim 11, in which substantially sumultaneously heating a quantity of fasteners comprises advancing a randomly arranged mass of fasteners through a heating chamber.

13. The method defined in claim 12, which comprises advancing the fasteners on an endless conveyor, and depositing heated fasteners from the conveyor into a cooling bath to quickly set the fused deposits.

14. The method defined in claim 13, which comprises separating the fasteners as they are deposited in the bath.

15. The method defined in claim 14, in which separation of the fasteners comprises brushing them off the end of the conveyor into the bath.

16. Apparatus for making friction threaded fasteners which comprises a first conveyor for continuously advancing a series of externally threaded fasteners with their axes vertical, applicator means at the side of the path of advance of the fasteners for applying deposits of a fluid wetting agent to extend around the threaded portions of the fasteners, powder supply means at the side of the path of advance of the fasteners for supplying a thermoplastic resin powder to the deposits of wetting agent as the fasteners continue to advance to form annular deposits of a fluid mixture of wetting agent and resin powder on the fasteners, flash heating means at the side of the path of advance of the fasteners to fuse resin particles only at and adjacent the surfaces of the deposits of the mixture of wetting agent and powder to convert the exposed surfaces of the deposits to a dry, non-tacky condition without fusing all particles within the deposits to each other or to the thread surfaces, a second horizontal conveyor for receiving and advancing a mass of the fasteners after the fluid mixture deposit has at least substantially dried to leave a substantially solid cohesive deposit of discrete resin particles, a heating oven through which the fasteners advance to fuse the discrete particles into a continuous fluid mass, means for cooling the fasteners to form the deposits into solid continuous masses fused to the thread surfaces of the fasteners comprising a cooling bath into which the fasteners are deposited from the conveyor in separated condition, and brush means for brushing the fasteners in separated condition from the second conveyor into the bath.

17. The method of making friction fasteners which comprises advancing a multiplicity of externally threaded fasteners continuously in a series and forming thereon as they advance deposits of a fluid slurry mixture containing discrete thermoplastic resin particles in a fluid carrier, sequentially treating the fasteners as they advance to convert the exposed surfaces of the deposits to a dry, non-tacky condition, agglomerating a mass of the fasteners, retaining the mass of fasteners until the liquid carrier is substantially eliminated to leave a substantially solid deposit formed of discrete thermoplastic particles, and subjecting them to an essentially batch type heat treatment to fuse the discrete particles into an essentially continuous fluid deposit, and abruptly cooling the fasteners to solidify the fluid resin.

18. The method of claim 17 which comprises cooling the fasteners by immersing them in essentially separated condition in a cooling bath.

19. The method of claim 17, which comprises heating the fasteners in mass while advancing them through a heating oven.

20. The method of claim 17, which comprises heating and immersing the fasteners by advancing them in mass on a belt through a heating oven, and depositing them at the end of the belt in a cooling bath.

21. The method of claim 20, and brushing the fasteners off the end of the belt into the bath.

22. The method of making friction threaded fasteners which comprises continuously advancing a series of externally threaded fasteners, sequentially forming in the thread grooves of the fasteners as they advance fluid deposits of a mixture of a wetting agent and a powder consisting of discrete thermoplastic resin particles, sequentially treating the fasteners as they advance to convert the exposed surfaces of the deposits to a dry, non-tacky condition, thereafter accumulating the fasteners in agglomerated condition and retaining them until the wetting agent is substantially completely eliminated to leave the individual deposits in the form of substantially solid cohesive bodies of at least partly discrete resin particles, fusing the resin particle deposits into continuous fluid condition by substantially simultaneously heating a quantity of the accumulated fasteners to a temperature sufficient to fuse the resin particles, and finally abruptly chilling the fused resin into continuous solid deposits fused to the adjacent thread surfaces.

23. The method as defined in claim 22, which comprises forming the deposits of the fluid mixture by first sequentially depositing in the thread grooves of the fasteners a viscous wetting agent to form and retain a cross-section in which it fills the thread groove substantially to the crests of the threads but does not extend radially outwardly therebeyond, and thereafter supplying the powder to the exposed surfaces of the deposits of wetting agents to penetrate into the deposits to form the aforesaid mixture.

24. The method as defined in claim 22, in which the said treatment of the fasteners comprises sequentially flash heating and then cooling the exposed surfaces of the deposits as the fasteners continue to advance.

25. The method as defined in claim 24, in which the substantially simultaneous heating of a quantity of fasteners comprises agglomerating a quantity of fasteners on a conveyor and advancing the quantity of fasteners slowly through a heating chamber dimensioned to bring the agglomerated fasteners to the required temperature during transit of the chamber.

26. The method as defined in claim 25, in which the abrupt chilling of the fasteners comprises depositing the heated fasteners in separated condition into a cooling bath.

27. The method as defined in claim 26, in which the fasteners are deposited in separated condition in the cooling bath by advancing them on a horizontal conveyor, and brushing them individually off the end of the conveyor into the bath.

* * * * *